US010227839B2

(12) United States Patent
Xu et al.

(10) Patent No.: US 10,227,839 B2
(45) Date of Patent: Mar. 12, 2019

(54) PRESSURE-TRIGGERED DEGRADABLE-ON-COMMAND COMPONENT OF A DOWNHOLE TOOL AND METHOD

(71) Applicants: Yingqing Xu, Tomball, TX (US); Zhiyue Xu, Cyrpress, TX (US); James Doane, Friendswood, TX (US)

(72) Inventors: Yingqing Xu, Tomball, TX (US); Zhiyue Xu, Cyrpress, TX (US); James Doane, Friendswood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/482,249

(22) Filed: Apr. 7, 2017

(65) Prior Publication Data

US 2018/0291699 A1 Oct. 11, 2018

(51) Int. Cl.
*E21B 33/12* (2006.01)
*E21B 43/26* (2006.01)

(52) U.S. Cl.
CPC ..... *E21B 33/1208* (2013.01); *E21B 43/26* (2013.01)

(58) Field of Classification Search
CPC ..... E21B 2034/007; E21B 29/02; E21B 33/1204; E21B 34/10; E21B 36/02; E21B 47/00; E21B 47/06; E21B 47/065
See application file for complete search history.

(56) References Cited

U.S. PATENT DOCUMENTS 6,925,937 B2 * 8/2005 Robertson ..... E21B 29/02 102/202
2008/0066923 A1 3/2008 Xu
2012/0031626 A1 2/2012 Clayton et al.
2014/0196899 A1 7/2014 Jordan et al.
2014/0251612 A1 9/2014 Powers
2018/0171737 A1 * 6/2018 Xu ..... E21B 29/02

FOREIGN PATENT DOCUMENTS

WO 2005090742 A1 9/2005

OTHER PUBLICATIONS

Notification of Transmittal of the International Search Report and the Written Opinion of the International Searching Authority, or the Declaration; PCT/US2080/021095; dated Jun. 25, 2018: 7 pages.

* cited by examiner

*Primary Examiner* — James G Sayre
(74) *Attorney, Agent, or Firm* — Cantor Colburn LLP

(57) ABSTRACT

A downhole tool including a housing, a first portion of a trigger mechanism disposed in the housing, a degradable-on-command component movably disposed within the housing, a second portion of the trigger mechanism disposed in the component, the component being configured to positionally respond to an external input to dispose the first portion and second portion in operational contact with one another resulting in an initiation of degradation of the degradable-on-command component. A method for removing a component of a downhole tool.

20 Claims, 2 Drawing Sheets

PRESSURE-TRIGGERED DEGRADABLE-ON-COMMAND COMPONENT OF A DOWNHOLE TOOL AND METHOD

BACKGROUND

In the drilling and completion industry, tools are ubiquitously used to create, seal, support and treat boreholes and the formation they are in for various reasons. Such tools are of great advantage to the companies who employ them ensuring profitable extraction of resources from subsurface reservoirs. Sometimes however, the very tools that are so haloed for their valuable contributions to the recovery of resources can also be an impediment to that same recovery. In these cases, the tools need to be removed from the borehole via drilling, milling or tripping, for example. Each of these activities comes at not insignificant expense and accordingly the art will always welcome alternatives that reduce cost and or time required to remove impediments to the profitable extraction or resources.

SUMMARY

A downhole tool including a housing, a first portion of a trigger mechanism disposed in the housing, a degradable-on-command component movably disposed within the housing, a second portion of the trigger mechanism disposed in the component, the component being configured to positionally respond to an external input to dispose the first portion and second portion in operational contact with one another resulting in an initiation of degradation of the degradable-on-command component.

A method for removing a component of a downhole tool including exerting an external influence on a degradable-on-command component having at least a portion thereof composed of an energetic material within a housing, releasing the external influence on the component thereby facilitating movement of the component to a position whereby a triggering mechanism becomes operational, igniting the energetic material of the degradable-on-command component with the triggering mechanism.

A method for fracturing a borehole formation including pressuring on a downhole tool having, a housing, a first portion of a trigger mechanism disposed in the housing, a degradable-on-command component movably disposed within the housing, a second portion of the trigger mechanism disposed in the component, the component being configured to positionally respond to an external input to dispose the first portion and second portion in operational contact with one another resulting in an initiation of degradation of the degradable-on-command component, fracturing the formation with the pressuring, reducing the pressuring, and degrading the degradable-on-command component.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
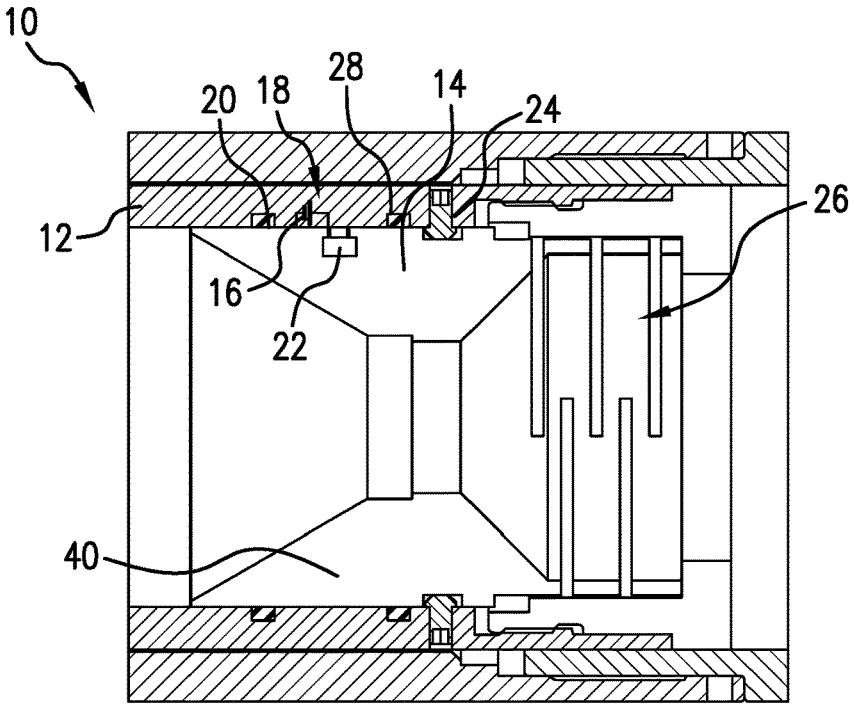
FIG. 1 is a cross sectional view of a pressure-triggered degradable-on-command downhole component as disclosed herein in a pre-pressured condition.

Referring to FIG. 1, a downhole tool 10 includes a housing 12 and a pressure-triggered component 14. In an embodiment, the component 14 is moveable in the housing 12 pursuant to pressure applied thereon. In an embodiment the movement is a sliding movement that may be longitudinal in a direction of an axis of the tool 10. Depending upon the position of the component 14 relative to the housing, the component may be commanded to degrade or not commanded to degrade thereby rendering the component pressure-triggered degradable-on-command component of a downhole tool.

The housing includes a portion 16 of a trigger mechanism 18 that may be an electric mechanism such as a battery or a conductor configured to activate a battery. This mechanism 18 is maintained in a protected environment within the housing 12 by seals 20 that interact with the component 14. The component 14 will include a portion 22 of the trigger mechanism 18, which likewise to portion 16 may be a battery or a conductor, etc. and in any event will be whatever portion of the trigger mechanism 18 is not represented in portion 16 such that bringing portions 16 and 22 together will complete the trigger mechanism 18 allowing for a triggering event to occur.

The component 14 is maintained in the housing 12 in an initial position, for run in or transportation, where the portions 16 and 22 are not operationally in contact with each other. The component 14 is to be held in that position until the degrade-on-command event is initiated. In an embodiment, the component 14 is so held in this initial position by a release mechanism 24 such as one or more shear screws.

Figure 2:
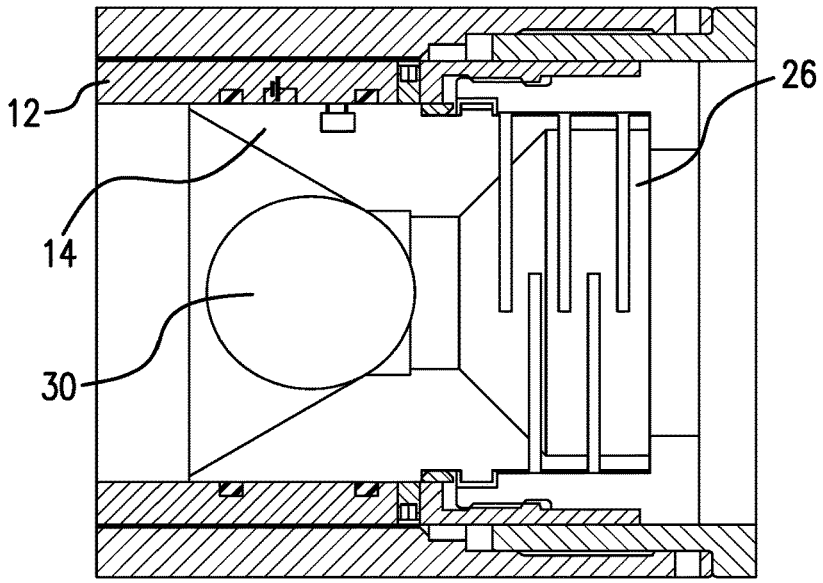
FIG. 2 is the cross section of FIG. 1 with the component in a pressured condition.

As illustrated, and not by way of limitation, the component 14 is a ball seat. Other configurations of components are certainly contemplated. In an embodiment, the component in its initial position as illustrated in FIG. 1 also includes a biasing member 26 that is configured and positioned to urge the component 14 to move to another position should such movement be permitted by other impediments such as pressure or the release mechanism 24. The biasing member 26 may be a spring and in embodiments may be a coil spring or other type of spring composed of metal or other resilient material such as polymeric material. Specifically, movement of the component 14 for the embodiment illustrated is made plain with reference to FIGS. 2 and 3. Illustrated in FIG. 2 is a plug 30 having landed on the component 14. Exerted pressure through tubing (not shown) uphole of the tool 10 acts against the seated plug 30 to urge the component 14 in a downstream direction which loads the release mechanism 24 until release. The pressure used for this operation is in some embodiments also used for other operational endeavors such as for fracturing a formation within which the tool 10 is located. In other words, the component may be configured to support significant hydraulic pressure utilized for other downhole needs.

Figure 3:
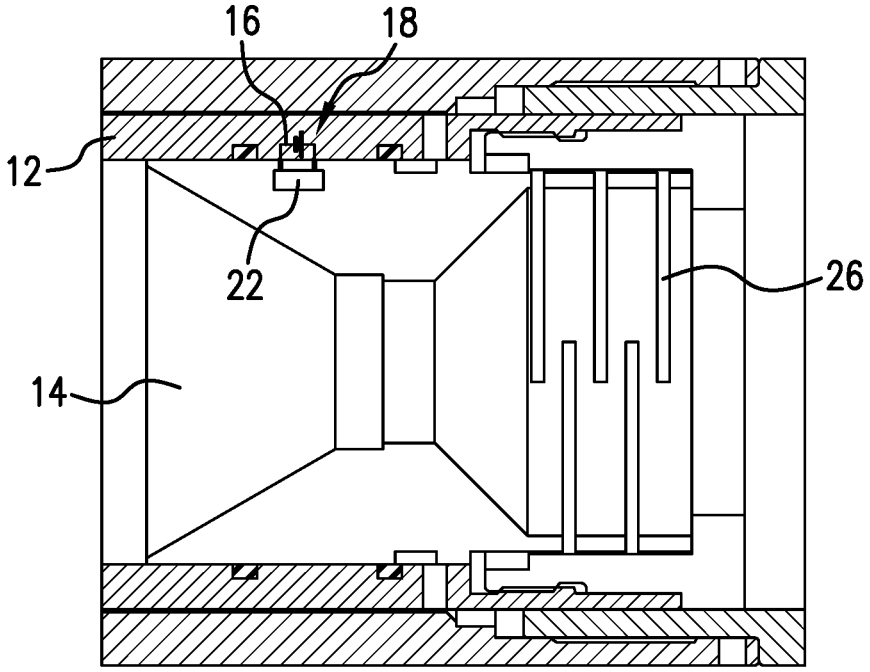
FIG. 3 is the same cross section illustrated in a post-pressured condition.

Once the operation for which increased hydraulic pressure is required has been satisfied, pressure is reduced to a point where the biasing member 26 possesses greater mobile capacity than the hydraulic pressure remaining on the component 14 resulting in the component 14 moving due to the biasing member's influence. In the illustrated embodiment, that movement is in the uphole direction or to the left in the Figures. Without the impediment of the release member 24, which has since been dispensed with (a shear screw embodiment can be seen parted in FIG. 2) pursuant to the higher pressure exerted on the component 14 in the previous operation, the component 14 may move under the influence of the biasing member 26 to a position it had not occupied initially which then facilitates the operational integrity of the portions 16 and 22 of the trigger mechanism 18. This position is illustrated in FIG. 3.

The importance of the triggering mechanism 18 becomes apparent when it is understood that the component 14 is composed of at least in part an energetic material 40 that while having sufficient strength and integrity to withstand the elevated pressure of the previously described operation will nonetheless degrade rapidly upon command, that command coming in the form of the triggering mechanism 18 being activated. The triggering mechanism 18 is configured to cause ignition of the energetic material of the component 14. In an embodiment, the triggering mechanism uses a battery and a member responsive to current flow to cause a spark or rapid heat buildup to a level above the ignition temperature of the energetic material. Once ignited, the energetic material degrades to a point that structural integrity of the component is lost and the component will fall away either in pieces interposed between energetic portions or in total as desired by the manufacturer.

Energetic material having the structural properties and degrade-on-command properties indicated above includes material commercially available from Baker Hughes Incorporated, Houston, Tex. Such material is as described below.

The energetic material can be in the form of continuous fibers, wires, foils, particles, pellets, short fibers, or a combination comprising at least one of the foregoing. In the degradable-on-command components, the energetic material is interconnected in such a way that once a reaction of the energetic material is initiated at one or more starting locations or points, the reaction can self-propagate through the energetic material in the degradable-on-command components. As used herein, interconnected or interconnection is not limited to physical interconnection.

The energetic material comprises a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermite materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but are not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

The energetic material may also include energetic polymers possessing reactive groups, which are capable of absorbing and dissipating energy. During the activation of energetic polymers, energy absorbed by the energetic polymers causes the reactive groups on the energetic polymers, such as azido and nitro groups, to decompose releasing gas along with the dissipation of absorbed energy and/or the dissipation of the energy generated by the decomposition of the active groups. The heat and gas released promote the degradation of the degradation-on-command components.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

In embodiments, it is further contemplated that the housing and/or plug member may also be constructed of the degradable-on-command material for a fully degradable tool, if desired. It is also contemplated that portions of the housing and/or plug may comprise the degradable-on-command material in order to allow those components to self-disassemble into small pieces that then may be dropped to the bottom of the borehole or circulated out.

Set forth below are some embodiments of the foregoing disclosure:

Embodiment 1

A downhole tool including a housing, a first portion of a trigger mechanism disposed in the housing, a degradable-on-command component movably disposed within the housing, a second portion of the trigger mechanism disposed in the component, the component being configured to positionally respond to an external input to dispose the first portion and second portion in operational contact with one another resulting in an initiation of degradation of the degradable-on-command component.

Embodiment 2

The downhole tool as in any prior embodiment wherein the first portion is one of a battery and a conductor.

Embodiment 3

The downhole tool as in any prior embodiment wherein the second portion is the other of the battery and the conductor.

Embodiment 4

The downhole tool as in any prior embodiment wherein the degradable-on-command component includes an energetic material.

Embodiment 5

The downhole tool as in any prior embodiment wherein the degradable-on-command component consists of an energetic material.

Embodiment 6

The downhole tool as in any prior embodiment wherein the degradable-on-command component is a ball seat.

Embodiment 7

The downhole tool as in any prior embodiment wherein the movable disposition of the degradable-on-command component is slidable.

Embodiment 8

The downhole tool as in any prior embodiment wherein the movement is longitudinal.

Embodiment 9

The downhole tool as in any prior embodiment wherein the tool further includes a release mechanism.

Embodiment 10

The downhole tool as in any prior embodiment wherein the release mechanism is a shear screw.

Embodiment 11

The downhole tool as in any prior embodiment wherein the tool further includes a biasing member.

Embodiment 12

The downhole tool as in any prior embodiment wherein the biasing member is a spring.

Embodiment 13

The downhole tool as in any prior embodiment wherein the initiation of degradation of the degradable-on-command component is by ignition.

Embodiment 14

The downhole tool as in any prior embodiment wherein the ignition is by spark.

Embodiment 15

The downhole tool as in any prior embodiment wherein the ignition is by heat.

Embodiment 16

A method for removing a component of a downhole tool including, exerting an external influence on a degradable-on-command component having at least a portion thereof composed of an energetic material within a housing, releasing the external influence on the component thereby facilitating movement of the component to a position whereby a triggering mechanism becomes operational, igniting the energetic material of the degradable-on-command component with the triggering mechanism.

Embodiment 17

The method as in any prior embodiment further including degrading the degradable-on-command component pursuant to the ignition.

Embodiment 18

The method as in any prior embodiment further including urging with a biasing member the degradable-on-command component to move following release of the external influence.

Embodiment 19

A method for fracturing a borehole formation including pressuring on a downhole tool having a housing, a first portion of a trigger mechanism disposed in the housing, a degradable-on-command component movably disposed within the housing, a second portion of the trigger mechanism disposed in the component, the component being configured to positionally respond to an external input to dispose the first portion and second portion in operational contact with one another resulting in an initiation of degradation of the degradable-on-command component, fracturing the formation with the pressuring, reducing the pressuring; and degrading the degradable-on-command component.

Embodiment 20

The method as in any prior embodiment wherein the initiation of degradation is by ignition.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a housing;

a first portion of a trigger mechanism disposed in the housing;

a degradable-on-command component movably disposed within the housing;

a second portion of the trigger mechanism disposed in the component, the component being configured to positionally respond to an external input to dispose the first portion and second portion in operational contact with one another resulting in an initiation of degradation of the degradable-on-command component.

2. The downhole tool as claimed in claim 1 wherein the first portion is one of a battery and a conductor.

3. The downhole tool as claimed in claim 2 wherein the second portion is the other of the battery and the conductor.

4. The downhole tool as claimed in claim 1 wherein the degradable-on-command component includes an energetic material.

5. The downhole tool as claimed in claim 1 wherein the degradable-on-command component consists of an energetic material.

6. The downhole tool as claimed in claim 1 wherein the degradable-on-command component is a ball seat.

7. The downhole tool as claimed in claim 1 wherein the movable disposition of the degradable-on-command component is slidable.

8. The downhole tool as claimed in claim 7 wherein the movement is longitudinal.

9. The downhole tool as claimed in claim 1 wherein the tool further includes a release mechanism.

10. The downhole tool as claimed in claim 9 wherein the release mechanism is a shear screw.

11. The downhole tool as claimed in claim 1 wherein the tool further includes a biasing member.

12. The downhole tool as claimed in claim 11 wherein the biasing member is a spring.

13. The downhole tool as claimed in claim 1 wherein the initiation of degradation of the degradable-on-command component is by ignition.

14. The downhole tool as claimed in claim 13 wherein the ignition is by spark.

15. The downhole tool as claimed in claim 13 wherein the ignition is by heat.

16. A method for removing a component of a downhole tool comprising:

exerting an external influence on a degradable-on-command component having at least a portion thereof composed of an energetic material within a housing;

releasing the external influence on the component thereby facilitating movement of the component to a position whereby a triggering mechanism becomes operational;

igniting the energetic material of the degradable-on-command component with the triggering mechanism.

17. The method as claimed in claim 16 further including degrading the degradable-on-command component pursuant to the ignition.

18. The method as claimed in claim 16 further including urging with a biasing member the degradable-on-command component to move following release of the external influence.

19. A method for fracturing a borehole formation comprising:

pressuring on a downhole tool having:

a housing;

a first portion of a trigger mechanism disposed in the housing;

a degradable-on-command component movably disposed within the housing;

a second portion of the trigger mechanism disposed in the component, the component being configured to positionally respond to an external input to dispose the first portion and second portion in operational contact with one another resulting in an initiation of degradation of the degradable-on-command component;

fracturing the formation with the pressuring;

reducing the pressuring; and degrading the degradable-on-command component.

20. The method as claimed in claim 19 wherein the initiation of degradation is by ignition.

* * * * *